US006424308B1

(12) United States Patent
Wu et al.

(10) Patent No.: US 6,424,308 B1
(45) Date of Patent: Jul. 23, 2002

(54) WIDEBAND MATCHING SURFACE FOR DIELECTRIC LENS AND/OR RADOMES AND/OR ABSORBERS

(75) Inventors: Te-Kao Wu, Rancho Palos Verdes; David L. Brundrett, Culver City; Andrew L. Roberts, Newhall; Brent T. Toland, Manhattan Beach; Kenneth A. Hummer, Redondo Beach, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/731,091

(22) Filed: Dec. 6, 2000

(51) Int. Cl.[7] ..... H01Q 19/06; H01Q 15/02

(52) U.S. Cl. ..... 343/753; 343/909

(58) Field of Search ..... 343/909, 910, 343/911 R, 872, 753, 756, 782, 754

(56) References Cited

U.S. PATENT DOCUMENTS

| | | | | | |
|---|---|---|---|---|---|
| 3,886,561 | A | * | 5/1975 | Beyer | 343/753 |
| 4,901,086 | A | * | 2/1990 | Smith | 343/909 |
| 4,980,696 | A | * | 12/1990 | Stone et al. | 343/872 |
| 5,426,443 | A | * | 6/1995 | Jenness, Jr. | 343/781 P |
| 5,543,814 | A | * | 8/1996 | Jenness, Jr. | 343/840 |

OTHER PUBLICATIONS

IEEE Transactions on Antennas and Propagation, Properties of Slotted Dielectric Interfaces, Robert E. Collin, Jan. 1959.

Optimal design for antireflective tapered two–dimensional subwavelength grating structures, Eric B. Grann M.G. Moharam, and Drew A. Pommet; Optical Society of America, vol. 12, No. 2, Feb. 1995.

* cited by examiner

*Primary Examiner*—Don Wong
*Assistant Examiner*—Hoang Nguyen
(74) *Attorney, Agent, or Firm*—McAndrews, Held & Malloy, Ltd.

(57) ABSTRACT

A wideband matching surface (600) for a dielectric lens antenna (100) is formed from a first dielectric layer (602) (e.g., Rexolite™) characterized by a first refractive index and a second dielectric layer (604) characterized by a second refractive index supporting the first dielectric layer (602). The first and second dielectric layers (602, 604) are formed by periodically removing material from the dielectric layers according to fill factors determined by:

$$n_i = \sqrt{\frac{F_i(1-F_i)(1-n_s^2)+n_s^2}{F_i(1-n_s^2)+n_s^2}}$$

The material may, for example, be periodically removed along two axes (702, 704) to form squares (706, 708), thereby provided reflected power attenuation for both horizontally and vertically polarized electromagnetic waves.

14 Claims, 7 Drawing Sheets

WIDEBAND MATCHING SURFACE FOR DIELECTRIC LENS AND/OR RADOMES AND/OR ABSORBERS

BACKGROUND OF THE INVENTION

The present invention relates to a wideband matching surface for dielectric lens antenna radome absorbers. In particular, the present invention relates to a wideband matching surface for reducing electromagnetic wave reflection and attenuation in a dielectric lens antenna radome or absorber.

An antenna is often a critical element of a communication system. The physical design and construction of an antenna are the keys to providing exceptional electromagnetic energy collecting and radiation properties. A dielectric lens antenna, however, may be considered as a transmission line section. As a transmission line section, the antenna is susceptible to electromagnetic reflections, standing waves, and other interference that attenuate the electromagnetic signal that the antenna collects or radiates. An attenuated signal may not propagate reliably to its destination, may require additional transmit power, or additional receiver amplification, as examples.

Thus, prior lens antennas often included a surface matching structure. The surface matching structure presents an input or output impedance that matches the impedance of the antenna to its surrounding medium. As a result, electromagnetic reflections, and attenuation, are greatly reduced.

In the past, however, surface matching structures were effective only over a small range of frequencies. Thus, an antenna could not operate outside the small range of transmit or receive frequencies without incurring significant attenuation of the electromagnetic signal. As a result, a communication system that needed to operate over a wide range of frequencies required multiple antennas with individual surface matching structures, thereby significantly increasing the cost and complexity of the communication system.

A need has long existed in the industry for a wideband matching layer that addresses the problems noted above and others previously experienced.

BRIEF SUMMARY OF THE INVENTION

A preferred embodiment of the present invention provides a wideband matching structure for a dielectric lens antenna. The matching structure is formed from a first dielectric layer (e.g., Rexolite™) characterized by a first refractive index and a second dielectric layer characterized by a second refractive index supporting the first dielectric layer.

The refraction indicies ($n_i$, i=1 or 2) of the first and second dielectric layers may be formed by periodically removing material from the dielectric layers along two orthogonal axes to form posts with fill factors ($F_i=w_i/p$, i=1 or 2) where p is the period of the lattice, and $w_i$ is the side length of the post.

The material is periodically removed along two axes to provide reduced reflection for both horizontally and vertically polarized electromagnetic waves.

As one specific example, the matching surface may be designed to provide 25 to 40 dB reflected power attenuation over 15 GHz to 35 GHz by providing a first refractive index of approximately 1.14 and a second refractive index of approximately 1.40, where the first Rexolite™ dielectric layer is approximately 0.107 inches thick and the second Rexolite™ dielectric layer is approximately 0.087 inches thick.

Another preferred embodiment of the present invention provides an antenna comprising a feed element, a dielectric lens antenna covering a feed element aperture, and a wideband matching surface supported by the dielectric lens antenna. The wideband matching surface comprises a first dielectric layer characterized by a first refractive index and a second dielectric layer characterized by a second refractive index supporting the first dielectric layer.

As noted above, at least one of the first dielectric layer and second dielectric layer have material periodically removed to provide at least one of the first and second refractive index. The material may be removed along two axes to form squares. The antenna dielectric may be Rexolite™, with the matching surface providing reflected power attenuation in the same fashion as a quarter wave matching section between the antenna dielectric and open space (or another boundary).

DETAILED DESCRIPTION OF THE INVENTION

Figure 1:
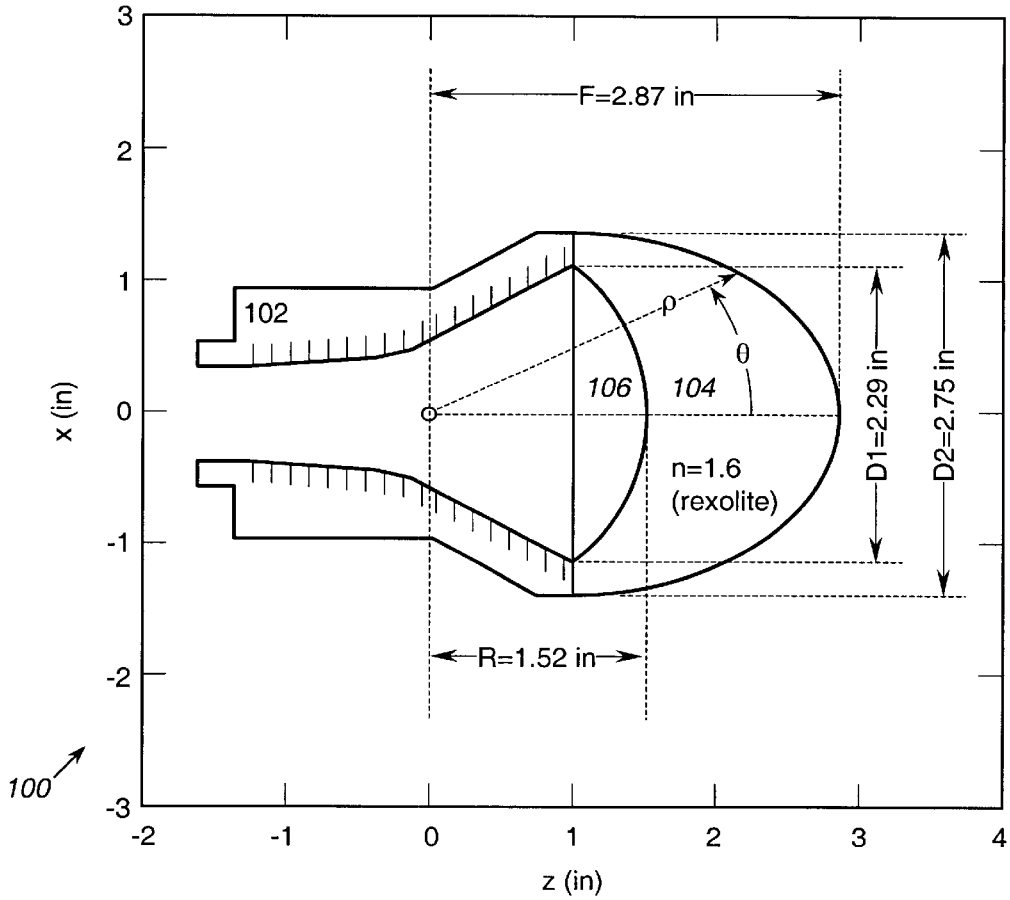
FIG. 1 illustrates an antenna for which a wideband surface matching layer will be provided.

Turning now to FIG. 1, that figure illustrates an antenna 100 for which a wideband surface matching structure will be provided. The antenna 100 includes a feed element 102 (in this instance, a feed horn), and a dielectric lens antenna 104 that covers the feed element aperture 106.

The antenna dielectric 104 may be made, for example, from Rexolite™, although other materials (e.g., Alumina™ are also suitable). Exemplary dimensions are provided in FIG. 1 for the antenna, which is designed to operate from approximately 15 GHz to 35 GHz, and primarily at 20 GHz and 30 GHz. The distance r is given by r(theta)=F(n−1)/(n−cos(theta)), where F is focal length, and n is the refractive index of Rexolite™, or approximately 1.6.

Electromagnetic waves travel from the feed element 102, through the lens antenna dielectric 104, and into free space (where n=1.0) during transmission. During reception, electromagnetic waves travel from free space into the lens antenna dielectric 104, and into the feed element 102. The discontinuous boundary between the antenna dielectric 104 and free space causes reflected electromagnetic power, and resulting disadvantageous attenuation of the electromagnetic wave. As will be explained in detail below, a wideband surface matching layer will be added to the antenna 100 to provide reflected power reduction in much the same fashion as a quarter wave matching structure.

Figure 2:
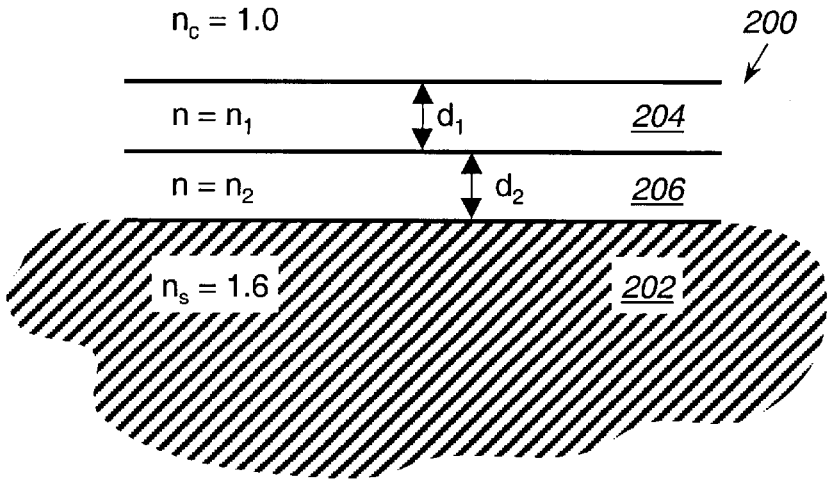
FIG. 2 shows a layer diagram of a wideband matching layer.

Turning next to FIG. 2, that figure illustrates a layer diagram of a wideband matching surface 200 disposed on top of an antenna dielectric 202. The wideband matching surface 200 includes a first dielectric layer 204 supported by a second dielectric layer 206. The first dielectric layer 204 is approximately d1 thick and is characterized by a first refractive index n1, while the second dielectric layer 206 is approximately d2 thick and characterized by a second refractive index n2. The first and second dielectric layers 204, 206 may be made from a common base material, such as Rexolite™ dielectric, or may be different dielectric materials. As will be explained in more detail below, the first and second dielectric layers 204, 206 have material selectively removed to provide a desired refractive index in each dielectric layer 204, 206.

Figure 3:
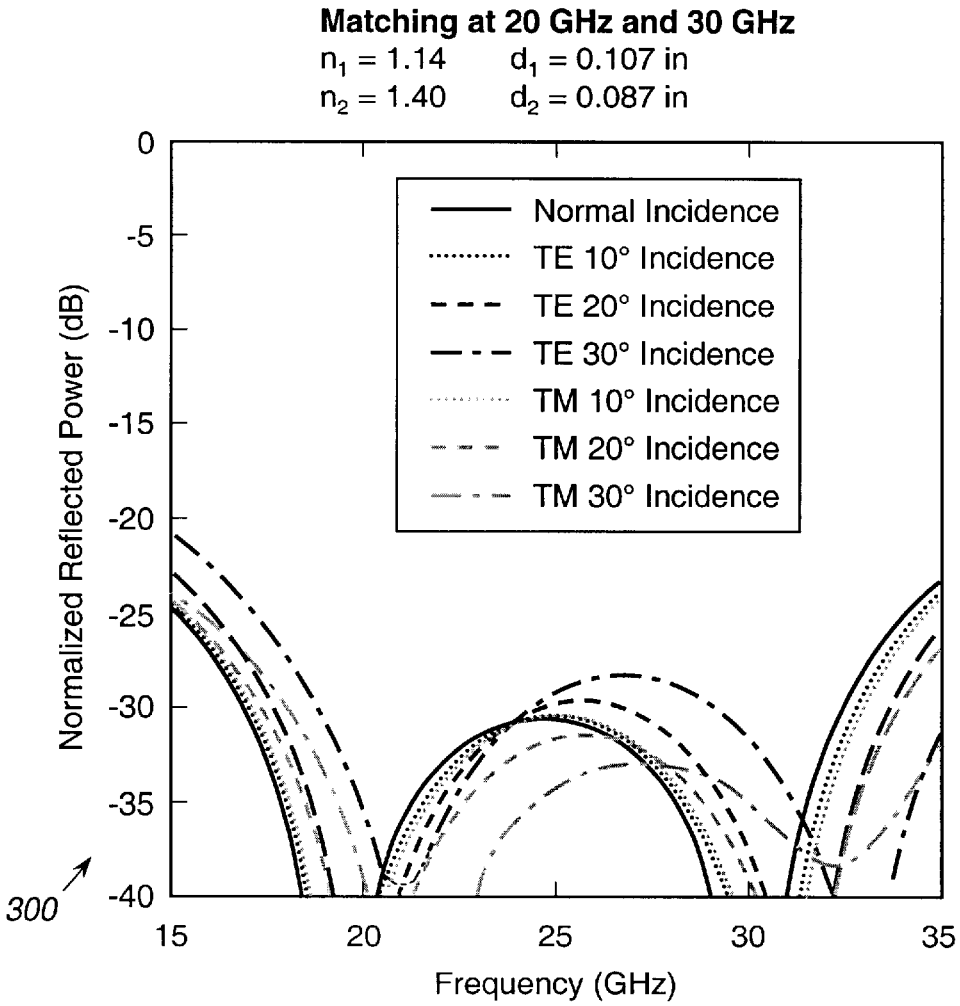
FIG. 3 depicts normalized reflected power attenuation for the wideband matching layer from 15 GHz to 35 GHz.

The desired refractive indices and thickness of the first and second dielectric layers 204, 206 are determined through simulation using commercially available electromagnetic wave and antenna modeling software. To that end, additional layers may be added to the wideband matching surface 200 if the simulations show a substantial benefit to doing so. FIG. 3 show a plot 300 of the results of such a simulation that was run to find a wideband matching design effective over 15 GHz to 35 GHz, and particularly at 20 GHz and 30 GHz.

In particular, the plot 300 shows the normalized reflected power reduction (i.e., the reduction in undesirable electromagnetic wave reflections) achieved by when n1 is approximately 1.14, n2 is approximately 1.40, d1 is approximately 0.107 inches, and d2 is approximately 0.087 inches. Note that under those parameters, the matching surface 200 provides at least 25 dB of reflection reduction at normal incidence, and more than 40 dB of reflection reduction at normal incidence at 20 GHz and 30 GHz. Thus, a two-layer matching structure may be used to provide wideband reflected power attenuation.

Figure 4:
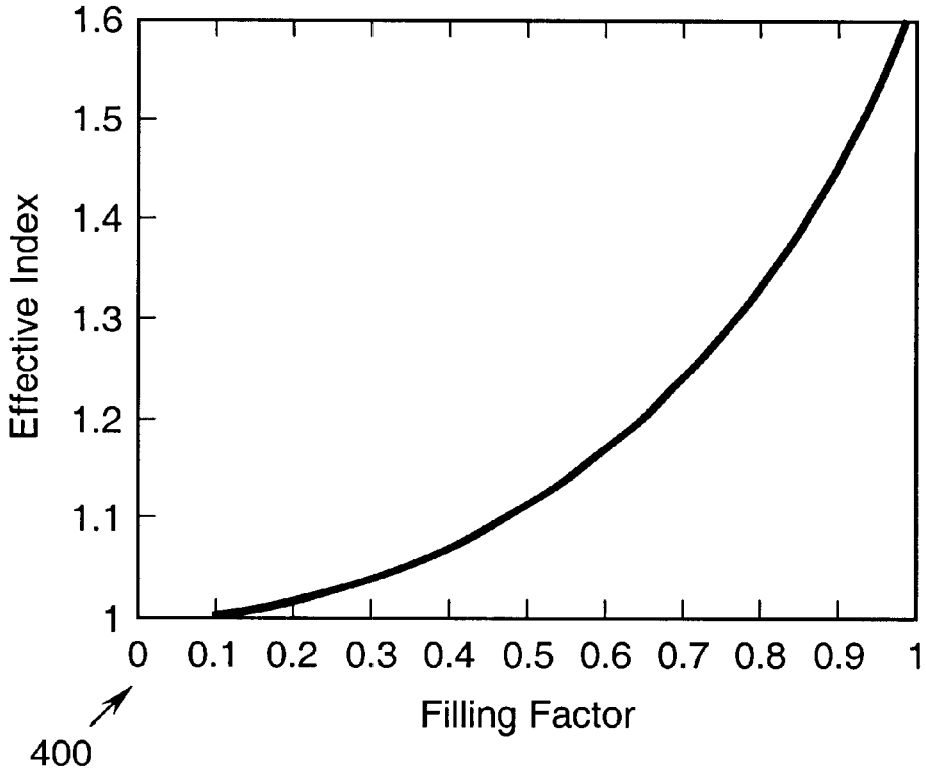
FIG. 4 shows a plot and equation used to determine fill factors.

In order for the first and second dielectric layers 204, 206 to be characterized by a desired refractive index, material may be periodically and selectively removed from a solid layer of dielectric (e.g., Rexolite™ dielectric) according to a fill factor. Turning to FIG. 4, that figure shows a plot 400 of effective refractive index against fill factor, and a corresponding fill factor equation 402:

$$n_i = \sqrt{\frac{F_i(1-F_i)(1-n_s^2)+n_s^2}{F_i(1-n_s^2)+n_s^2}}$$

In the fill factor equation 402, $n_i$ represents the desired effective refractive index for the $i^{th}$ layer, $F_i$ represent the fill factor for the $i^{th}$ layer, and $n_s$ represents the refractive index of the base or underlying dielectric material (e.g., 1.6 for Rexolite™ dielectric)

Figure 5:
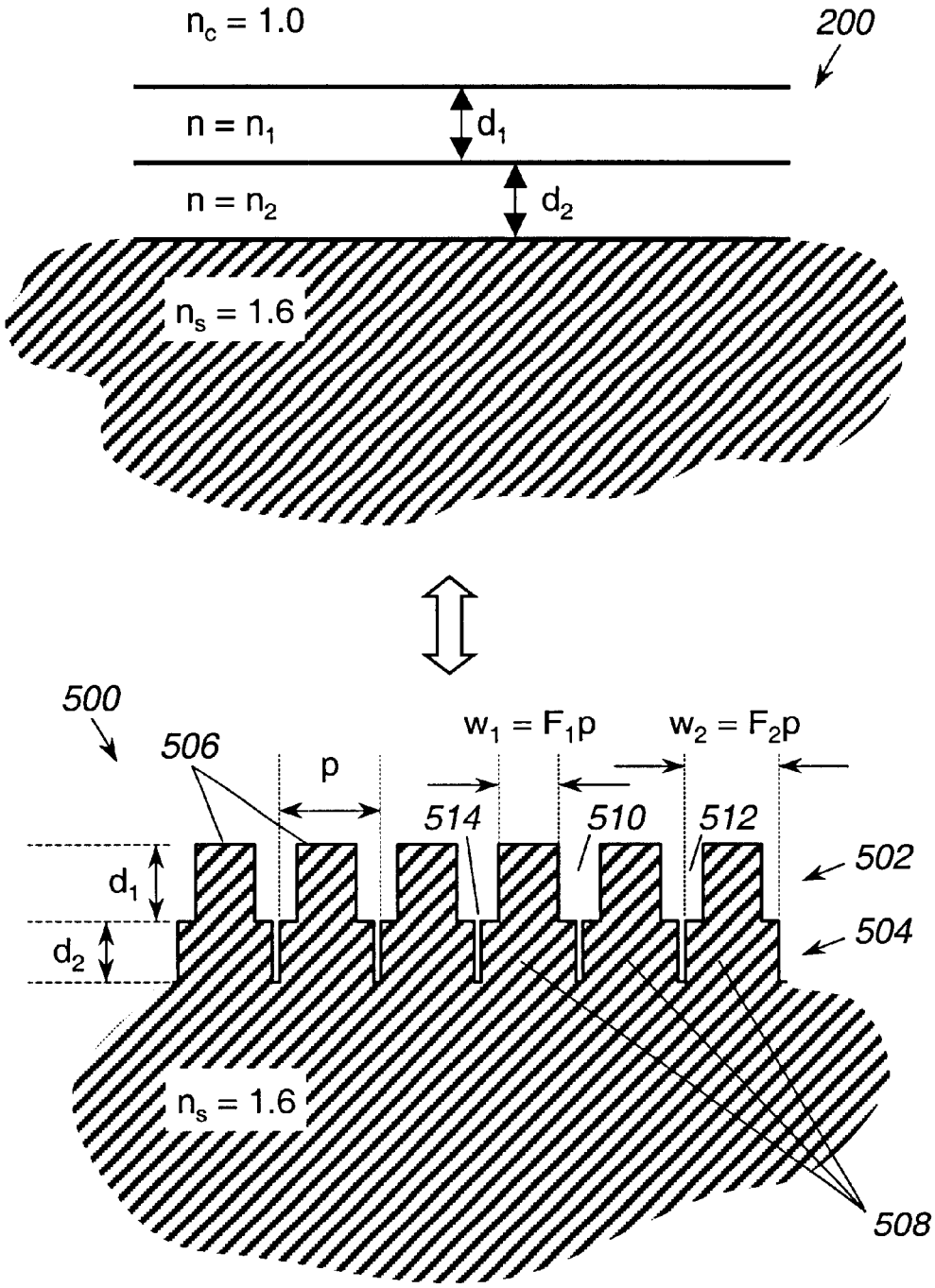
FIG. 5 shows an application of fill factors to a wideband matching structure.

With regard to FIG. 5, that figure again illustrates a layer view of a wideband matching surface 200, and an implementation 500 of the wideband matching surface using fill factors. As shown in FIG. 5, the implementation 500 includes a first dielectric layer 502 supported by a second dielectric layer 504. The parameter p is a predetermined distance that represents the period of the lattice. FIG. 5 also shows the application of the fill factor $F_1$ (for the first dielectric layer 502) and the fill factor $F_2$ (for the second dielectric layer 504). Thus, the width of the periodic sections 506 of dielectric material remaining in the first dielectric layer 502 is $w_1=F_1p$ and the width of periodic sections 508 of dielectric material remaining in the second dielectric layer 504 is $w_2=F_2p$. Excess dielectric material is selectively removed by etching or cutting to form grooves (three of which are denoted 510, 512, and 514).

Figure 6:
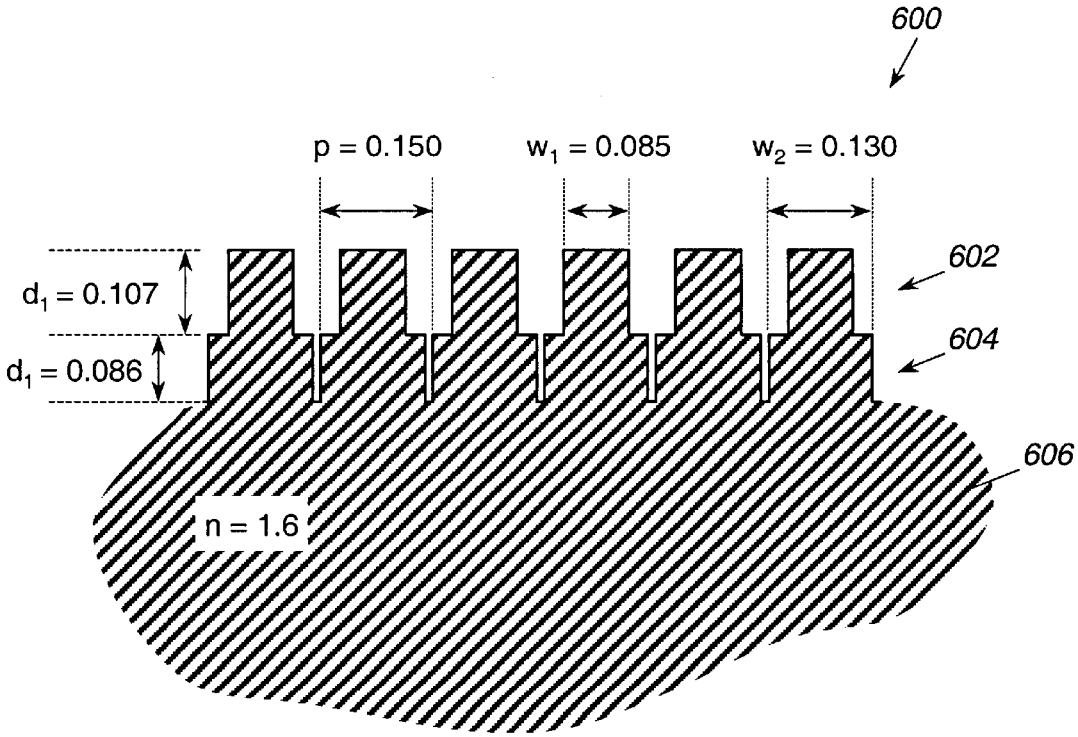
FIG. 6 illustrates a side view of one implementation of a wideband surface matching structure.

With regard to FIG. 6, that figure shows a side view of a wideband matching structure 600 designed for reflected power reduction specifically at 20 GHz and 30 GHz, with p=0.150 inches. The wideband matching structure 600 includes a first dielectric layer 602 characterized by $d_t$=0.107 inches, $w_1$=0.085 inches ($F_1$=0.567), and a second dielectric layer 604 characterized by d2=0.086 inches, w2=0.0130 inches (F2=0.867). The matching structure 600 rests on an antenna dielectric 606 (e.g., the antenna dielectric 104). Variations in the above parameters may be made, of course, while still allowing the matching surface 600 to provide greater than 25 dB reflected power attenuation over 15 GHz to 35 GHz, or, more specifically at 20 GHz and 30 GHz.

Figure 7:
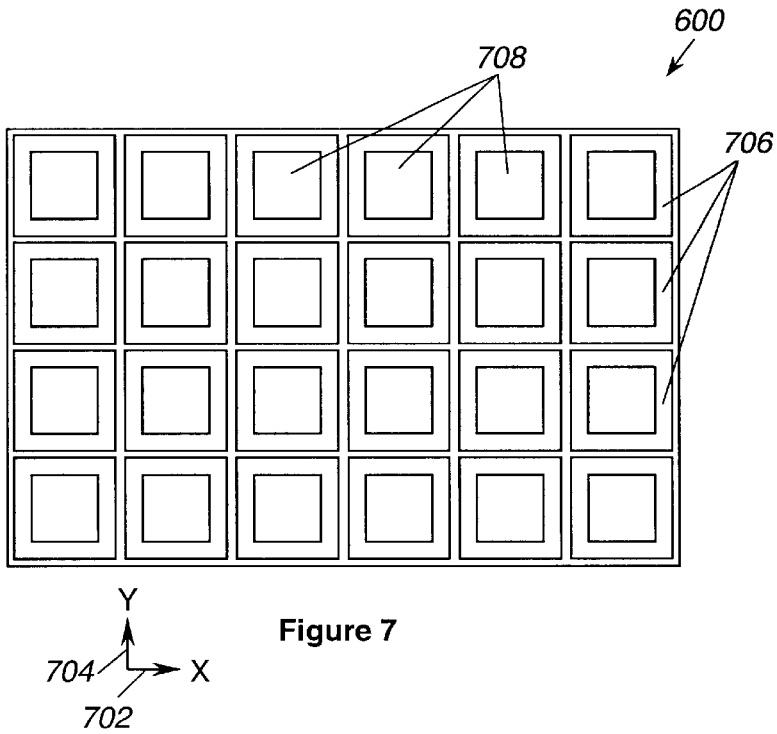
FIG. 7 shows a top view of a wideband surface matching structure.

Turning next to FIG. 7, that figure shows a top view of the matching surface 600 aligned on an x-axis 702 and y-axis 704. FIG. 7 shows that the fill factor is applied along both the X and Y axes to form squares approximately $w_1$ and $w_2$ on a side. The second dielectric layer squares are indicated at 706 and the first dielectric layer squares are indicated at 708.

The squares 706, 708 allow the matching surface 600 to provide reflected power attenuation for both horizontally polarized and vertically polarized electromagnetic waves. The squares 706, 708 are not required, however, and when an antenna is expected to receive or transmit electromagnetic waves polarized in a single direction, then the either the x-axis or y-axis may remain uncut or unetched.

Another example of a wideband matching structure suitable for use over 6 GHz to 18 GHz is summarized below in Table 1.

TABLE 1

| Dielectric Layer # | Dielectric Constant (index of refraction) | Groove depth or thickness (inches) | Groove period (inches) | Fill factor |
|---|---|---|---|---|
| 1 | 1.2 (1.095) | 0.2246 | 0.3 | 0.4816 |
| 2 | 1.92 (1.386) | 0.1776 | 0.3 | 0.852 |

Figure 8:
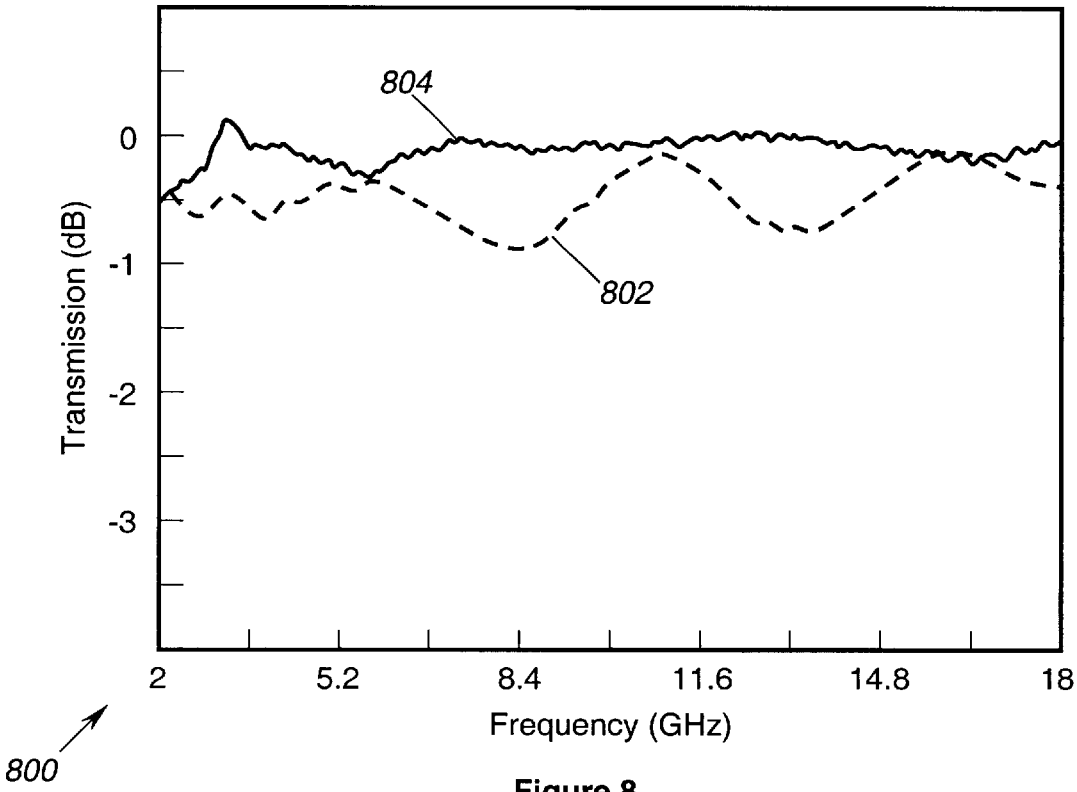
FIG. 8 shows a plot of transmission performance, 6 GHz to 18 GHz with and without a wideband matching surface.

Turning briefly to FIG. 8, that figure shows a plot 800 of transmission performance with and without the wideband matching surface specified in Table 1. FIG. 8 was generated under zero degree (or normal) incidence. FIG. 8 shows that the performance 802 without the wideband matching surface is significantly worse than the performance 804 with the matching surface.

Figure 9:
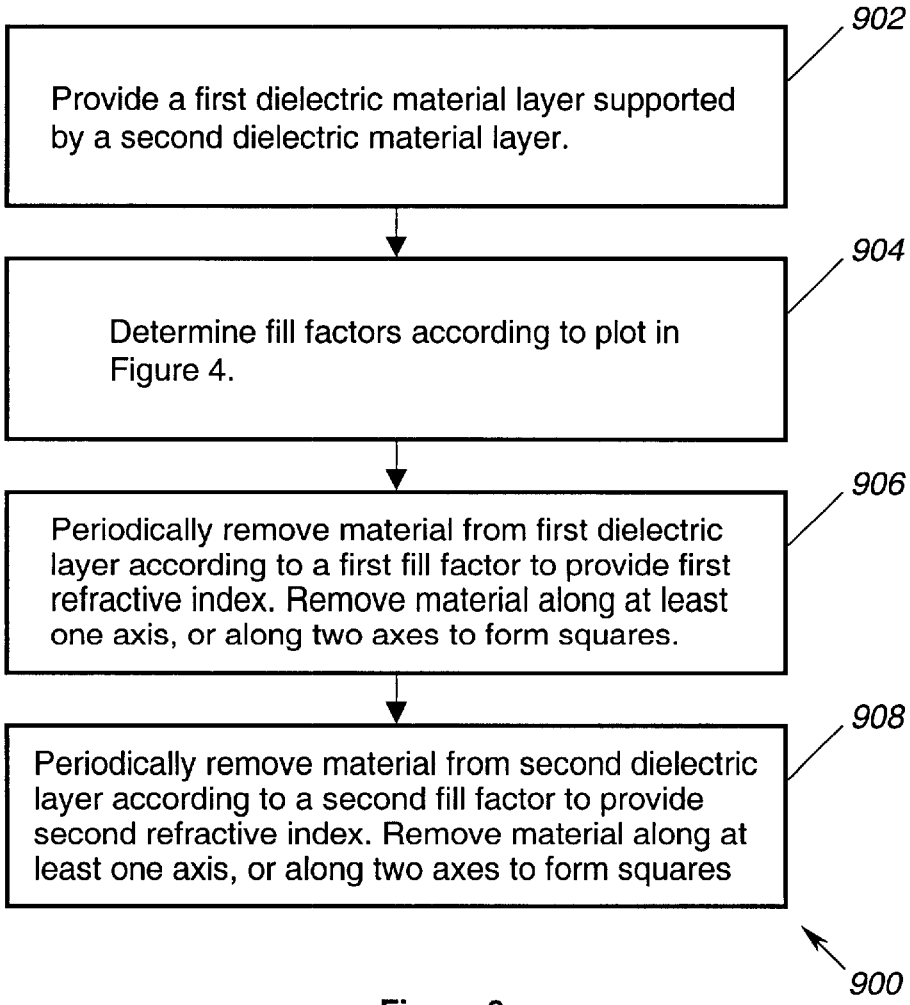
FIG. 9 depicts a method for forming a wideband matching structure.

With regard next to FIG. 9, a flow diagram 900 summarized a method for constructing a wideband matching surface. The method provides 902 a first dielectric material layer supported by a second dielectric material layer. The method also determines 904 fill factors for the dielectric material layers and periodically removes material 906 to create an effective refractive index in the first dielectric material layer, and periodically removes material 908 to create an effective refractive index in the second dielectric material layer. The first and second dielectric material layers act in combination to reduce reflected power.

The present surface matching structures provide impedance matching for wideband applications. As a result, a single antenna may be used to collect and radiate electromagnetic energy over a wide frequency range. The resulting communication system may therefore be smaller, lighter, less complex, and less expensive, thereby allowing, for example, a satellite with extended communication capabilities to be launched in relatively narrow confines provided in a launch vehicle.

While the invention has been described with reference to a preferred embodiment, those skilled in the art will understand that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. A wideband matching structure for a dielectric lens antenna radome or absorber, the matching structure comprising:

a first dielectric layer characterized by a first refractive index; and a second dielectric layer characterized by a second refractive index supporting the first dielectric layer, the first dielectric layer and the second dielectric layer in combination providing reflected power reduction over a predetermined range of frequency;

and wherein the first dielectric layer has material periodically removed according to a first fill factor to provide the first refractive index.

2. The wideband matching structure of claim 1, wherein the second dielectric layer has material periodically removed according to a second fill factor to provide the second refractive index.

3. The wideband matching structure of claim 2, wherein at least one of the first and second fill factors is determined according to:

$$n_i = \sqrt{\frac{F_i(1-F_i)(1-n_s^2)+n_s^2}{F_i(1-n_s^2)+n_s^2}}$$

wherein $n_i$ is a desired effective refractive index for the $i^{th}$ layer, $F_i$ is a fill factor for the $i^{th}$ layer, and $n_s$ is a base refractive index of dielectric material used to form the first and second dielectric layers.

4. The wideband matching structure of claim 1, wherein the first dielectric layer has material periodically removed along two axes according to the first fill factor.

5. The wideband matching structure of claim 4, wherein the second dielectric layer has material periodically removed along two axes according to the second fill factor.

6. The wideband matching structure of claim 4, wherein the first dielectric layer material has material periodically removed to form squares.

7. The wideband matching structure of claim 6, wherein the second dielectric layer material has material periodically removed to form squares.

8. A method for forming a wideband matching structure for an antenna, the method comprising:

providing a first dielectric layer characterized by a first refractive index; and providing a second dielectric layer characterized by a second refractive index supporting the first dielectric layer;

and wherein providing a first dielectric layer comprises periodically removing dielectric material from the first dielectric layer, and wherein providing a second dielectric layer comprises periodically removing dielectric material from the second dielectric layer.

9. The method of claim 8, wherein each step of periodically removing comprises periodically removing to form squares.

10. The method of claim 9, wherein each providing step comprises providing according to a fill factor determined according to:

$$n_i = \sqrt{\frac{F_i(1-F_i)(1-n_s^2)+n_s^2}{F_i(1-n_s^2)+n_s^2}}$$

wherein $n_i$ is a desired effective refractive index for the $i^{th}$ layer, $F_i$ is a fill factor for the $i^{th}$ layer, and $n_s$ is a base refractive index of dielectric material used to form the first and second dielectric layers.

11. An antenna comprising:

a feed element;

a dielectric lens antenna covering a feed element aperture; and a wideband matching surface supported by the antenna dielectric layer, the wideband matching surface comprising:

a first dielectric layer characterized by a first refractive index; and a second dielectric layer characterized by a second refractive index supporting the first dielectric layer.

12. The antenna of claim 11, wherein at least one of the first dielectric layer and second dielectric layer has material periodically removed to provide at least one of the first and second refractive index.

13. The antenna of claim 12, wherein at least one of the first and second refractive indices are provided using a fill factor determined according to:

$$n_i = \sqrt{\frac{F_i(1-F_i)(1-n_s^2)+n_s^2}{F_i(1-n_s^2)+n_s^2}}$$

wherein $n_i$ is a desired effective refractive index for the $i^{th}$ layer, $F_i$ is a fill factor for the $i^{th}$ layer, and $n_s$ is a base refractive index of dielectric material used to form the first and second dielectric layers.

14. The antenna of claim 12, wherein at least one of the first and second dielectric layers have material periodically removed along two axes to form squares.

* * * * *